US006386935B1

(12) United States Patent
Lin

(10) Patent No.: US 6,386,935 B1
(45) Date of Patent: May 14, 2002

(54) BUBBLE BLOWER COMBINATION TOY

(76) Inventor: Mon-Sheng Lin, 5th Fl., No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 09/576,237

(22) Filed: May 24, 2000

(51) Int. Cl.[7] ..... A63H 33/28
(52) U.S. Cl. ..... 446/16; 446/73
(58) Field of Search ..... 446/15, 16, 21, 446/71, 73, 74, 76; 220/662, 663

(56) References Cited

U.S. PATENT DOCUMENTS 5,839,936 A * 11/1998 Lin ..... 446/16
6,193,578 B1 * 2/2001 Weber ..... 446/15

* cited by examiner

*Primary Examiner*—Jacob K. Ackun
(74) *Attorney, Agent, or Firm*—Troxell Law Office PLLC

(57) ABSTRACT

A bubble blower combination toy includes a bubble blower formed of a liquid container and a bubble blowing shaft, the liquid container having a first recessed transparent chamber and a second recessed transparent chamber disposed at two opposite sides, a picture film mounted within the first recessed transparent chamber, a convex lens covered on the first recessed transparent chamber for enabling the user to view an enlarged image of the picture in the picture film, and a lamp assembly installed in the second recessed chamber and operated to emit light through the picture film and the convex lens in the second recessed transparent chamber.

3 Claims, 7 Drawing Sheets

BUBBLE BLOWER COMBINATION TOY

BACKGROUND OF THE INVENTION

The present invention relates to bubble blowing toys, and more specifically to a light and bubble blower combination toy.

A variety of bubble blowing toys have been disclosed, and have appeared on the market. Regular bubble blowing toys are simply used for blowing bubbles. Recently, various bubble-blowing toys with attached implement have been disclosed. These bubble blowing toys may be attached with writing materials or other small accessories.

SUMMARY OF THE INVENTION

It is one object of the present invention to provide a light and bubble blower combination toy, which has an advertisement design. It is another object of the present invention to provide a light and bubble blower combination toy, which uses a back light source to illuminate an advertisement design. To achieve these and other objects of the present invention, there is provided a light and bubble blower combination toy comprised of a bubble blower formed of a liquid container and a bubble blowing shaft, the liquid container having a first recessed transparent chamber and a second recessed transparent chamber disposed at two opposite sides, a picture film mounted within the first recessed transparent chamber, a convex lens covered on the first recessed transparent chamber for enabling the user to view an enlarged image of the picture in the picture film, and a lamp assembly installed in the second recessed chamber and operated to emit light through the picture film and the convex lens in the second recessed transparent chamber.

DETAILED DESCRIPTION OF THE PREFERRED EMBODIMENT

Figure 1:
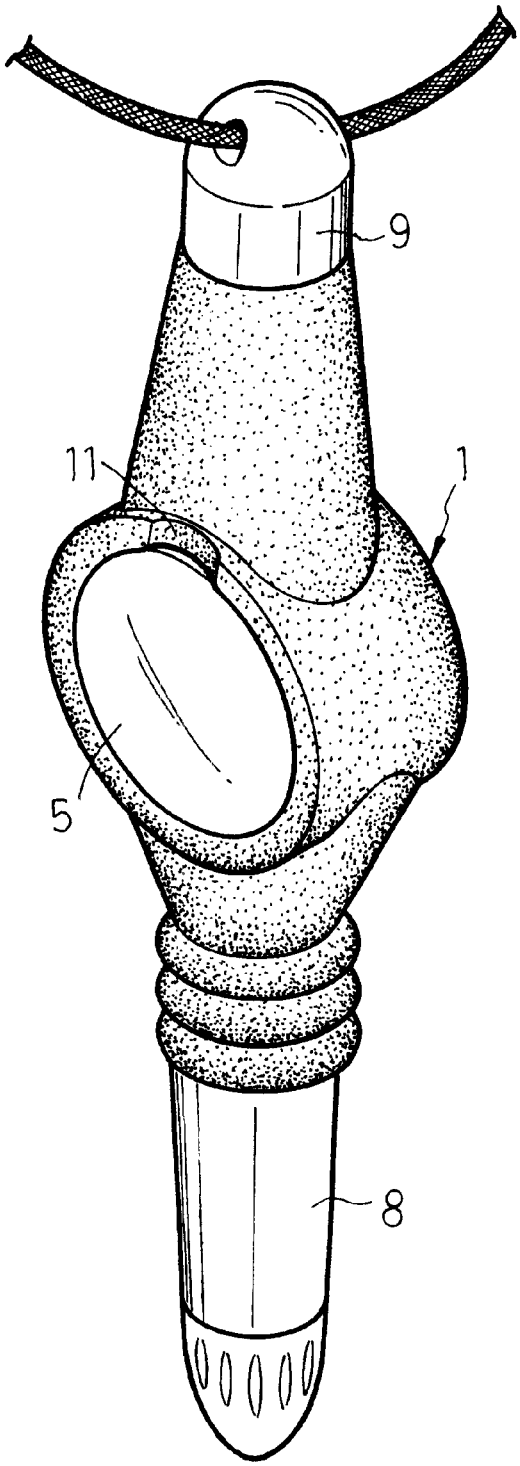
FIG. 1 is an elevational view of a first embodiment of the present invention.
Figure 2:
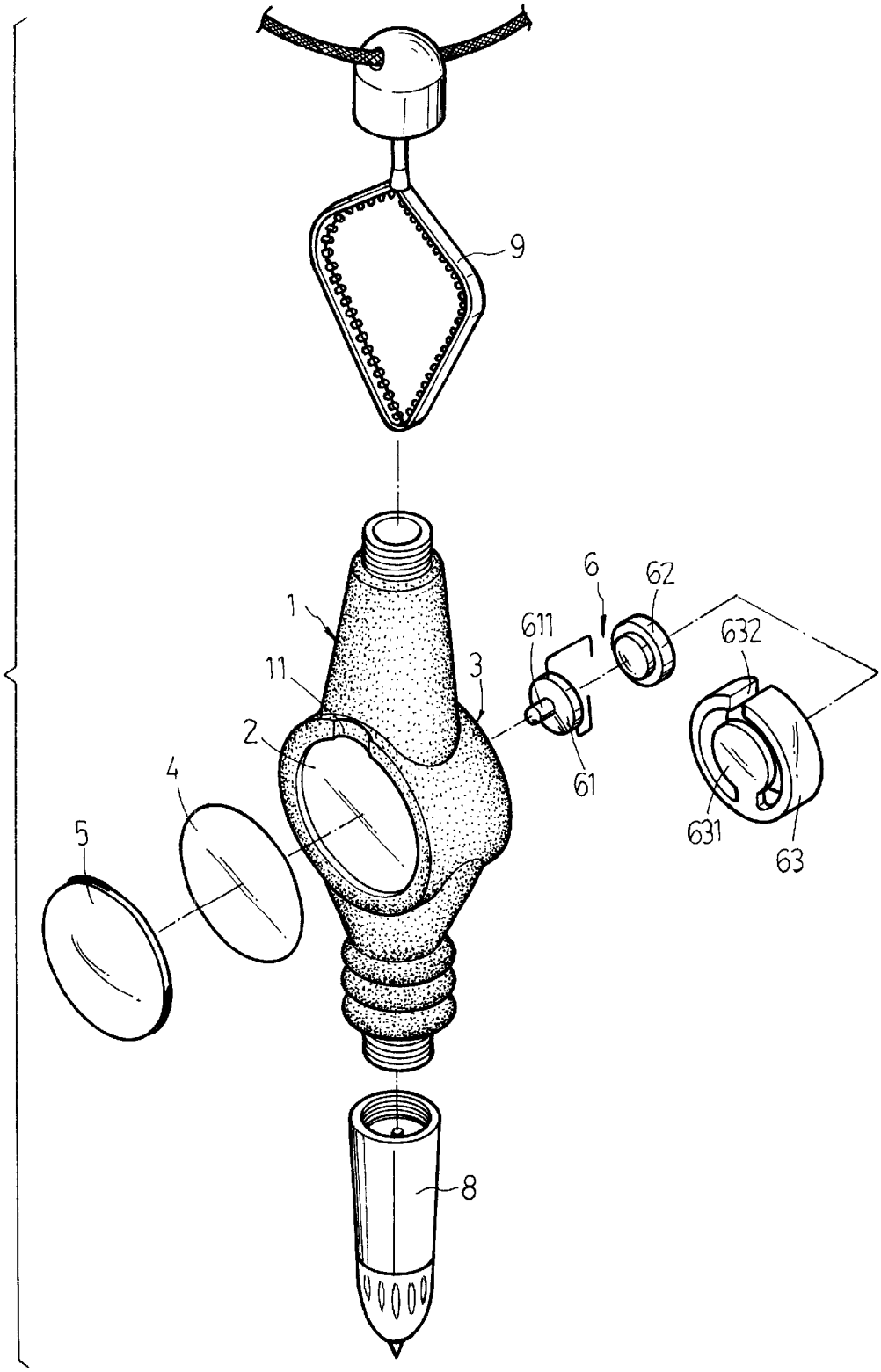
FIG. 2 is an exploded view of the first embodiment of the present invention.
Figure 3:
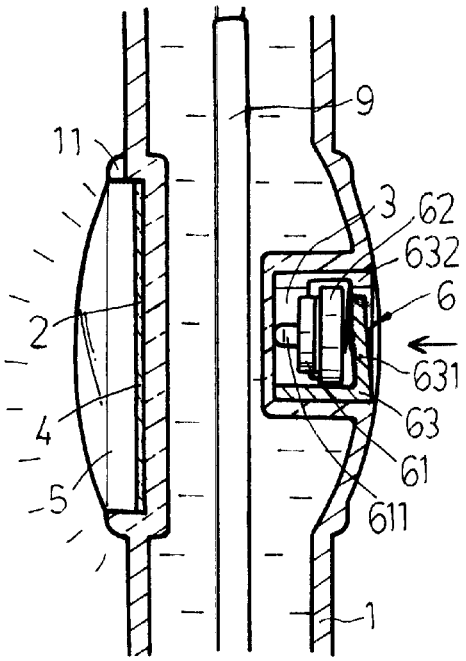
FIG. 3 is a sectional view of a part of the first embodiment of the present invention.

Referring to FIGS. from 1 through 3, the liquid container, referenced by 1, comprises a first recessed chamber 2 and a second recessed chamber 3 disposed at two opposite sides. The first recessed chamber 2 and the second recessed chamber 3 are spaced at a distance sufficient for enabling the bubble blowing shaft, referenced by 9, to be inserted into the inside of the liquid container 1 and dipped in the liquid contained in the liquid container 1. A picture film 4 is mounted within the first recessed chamber 2. The picture film 4 is a transparent film printed with letters, a graphic pattern, a picture, a logo, etc. A convex lens 5 covered on the first recessed chamber 2. A lamp unit 6 is mounted in the second recessed chamber 3. Through the convex lens 5, an enlarged image of the picture film 4 is viewed. Further, a notch 11 is made on the liquid container 1 through the periphery of the first recessed chamber 2. Through the notch 11, the convex lens 5 can easily be disconnected from the first recessed chamber 2 with the finger or a tool. A lamp assembly 6 is installed in the second recessed chamber 3 of the liquid container 1. The lamp assembly 6 is comprised of a lamp holder 61 holding a bulb 611, a battery cell 62, and a shell 63. The positive terminal lead-out wire of the bulb 611 is connected to the positive terminal of the battery cell 62. The negative lead-out wire of the bulb 611 is extended to the backside (the negative terminal side) of the battery cell 62, and kept away from the battery cell 62. The cover shell 63 comprises a spring plat 631 aimed at the battery cell 62, and a transversely extended peripheral slot 632 through which the negative terminal lead-out wire of the bulb 611 extends to the backside of the battery cell 62. When the spring plate 631 is depressed with the finger, the negative terminal lead-out wire of the bulb 611 is forced into contact with the negative terminal of the battery cell 62, causing the bulb 611 to be turned on to emit light through the first recessed chamber 2. The bottom wall of the first recessed chamber 2 and the bottom wall of the second recessed chamber 3 are transparent. The peripheral wall of the first recessed chamber 2 and the peripheral wall of the second recessed chamber 3 may be coated with a layer of paint. When the bulb 611 is turned on, light passes through the bottom wall of the first recessed chamber 2, the bottom wall of the second recessed chamber 3, and the picture film 4. The bubble-blowing shaft 9 is compressible, having a rhombic profile.

Referring to FIG. 1 again, the bottom end of the liquid container 1 is coupled with a pen 8 through a screw joint.

Figure 4:
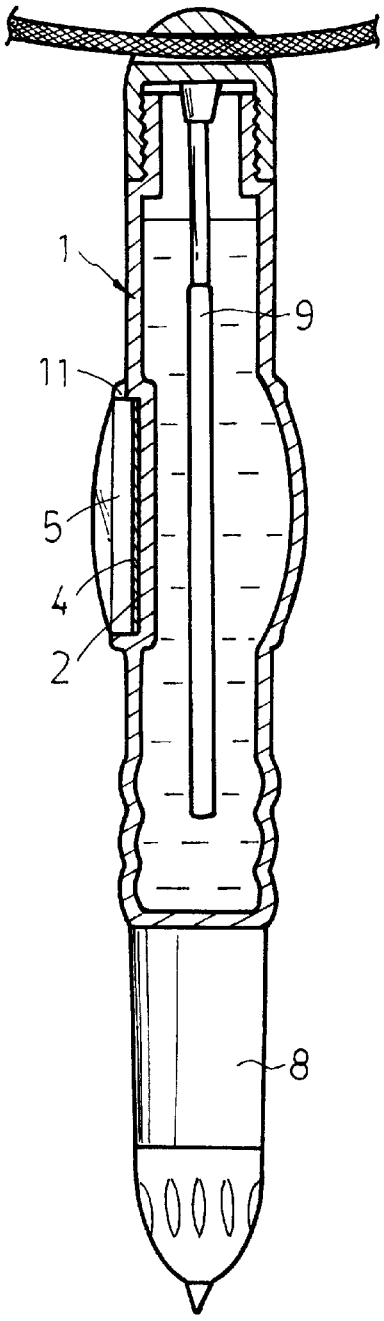
FIG. 4 is a sectional view of a second embodiment of the present invention.

FIG. 4 shows an alternate form of the present invention. According to this alternate form, the liquid container 1 has only one recessed chamber 2, which receives a picture film 4 and a convex lens 5.

Figure 5:
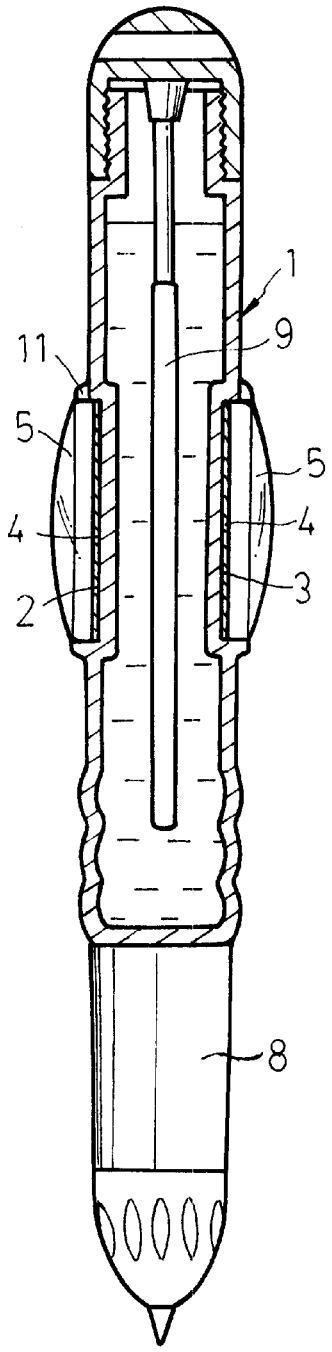
FIG. 5 is a sectional view of a third embodiment of the present invention.

FIG. 5 shows another alternate form of the present invention. According to this alternate form, the liquid container 1 has two recessed chambers 2 and 3 symmetrically disposed at two opposite sides, each receiving a respective picture film 4 and a respective convex lens 5.

Figure 6:
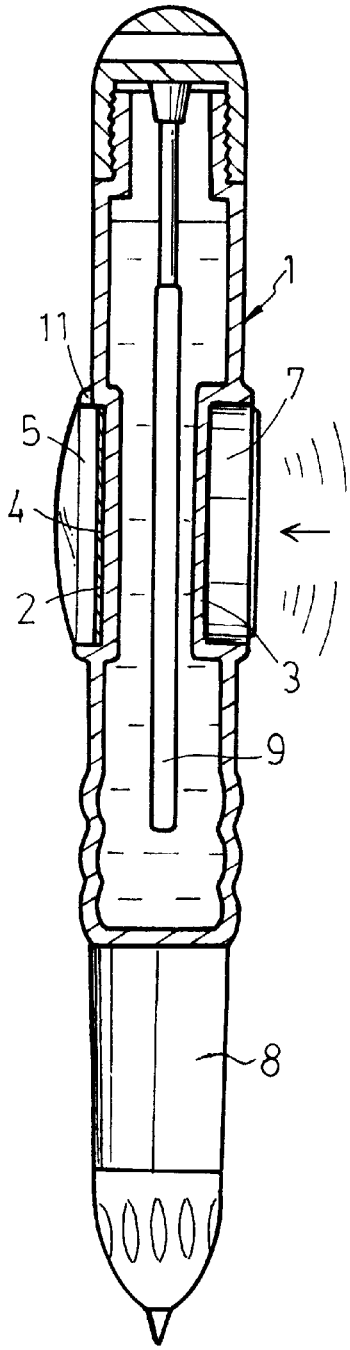
FIG. 6 is a sectional view of a fourth embodiment of the present invention.

FIG. 6 shows still another alternate form of the present invention. According to this alternate form, the liquid container 1 comprises a first recessed chamber 2, which receives a picture film 4 and a convex lens 5, and a second recessed chamber 3, which receives a music IC 7.

Figure 7:
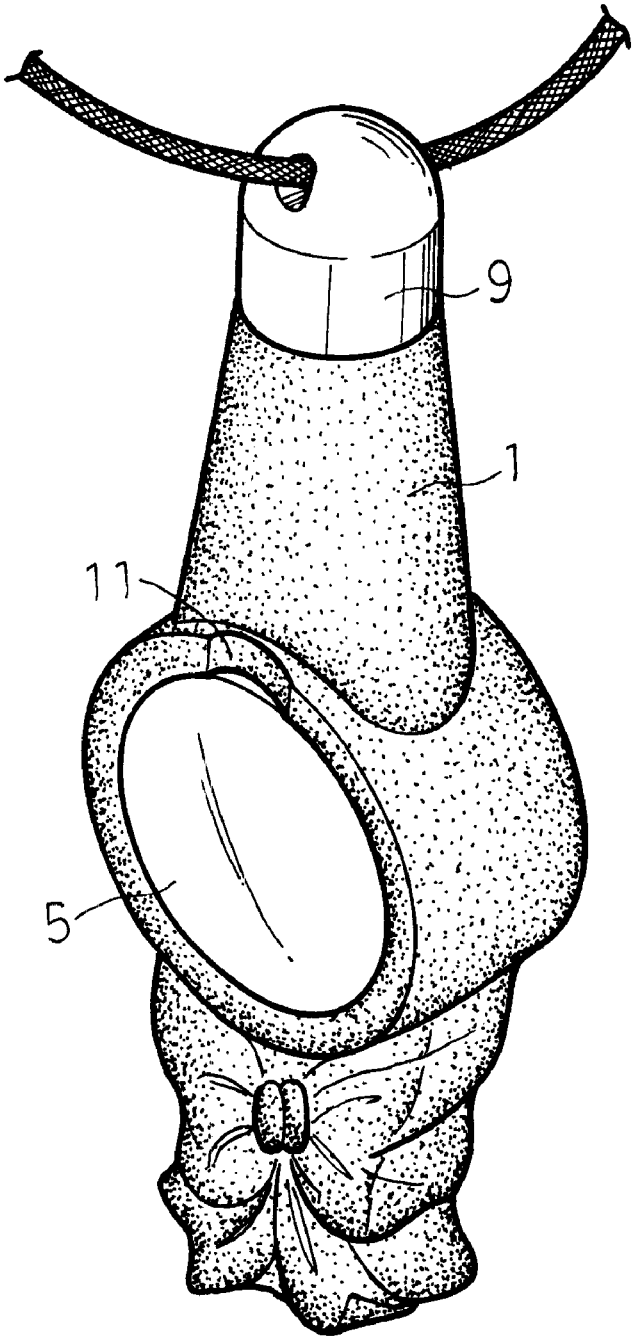
FIG. 7 is an elevational view of a fifth embodiment of the present invention.

FIG. 7 shows still another alternate form of the present invention. This embodiment eliminates the aforesaid pen 8 from the liquid container 1.

Figure 8:
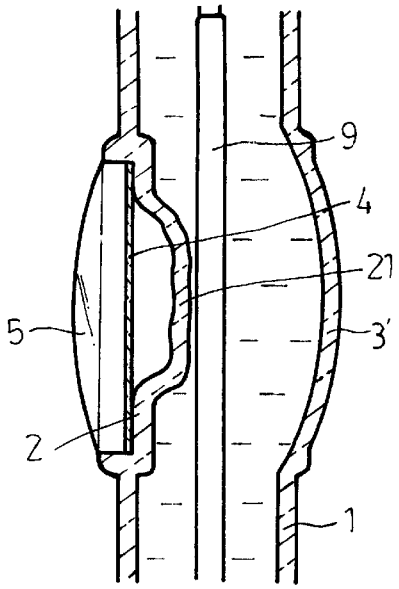
FIG. 8 is sectional view of the main structure of a sixth embodiment of the present invention.
Figure 9:
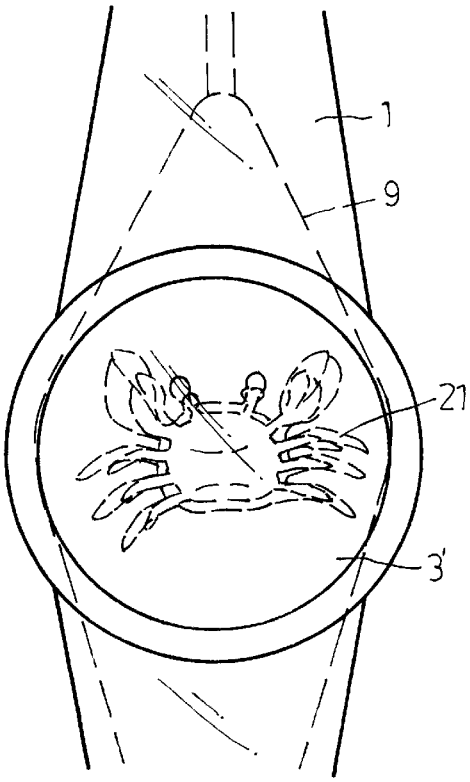
FIG. 9 is a front plain view of the sixth embodiment of the present invention.

FIGS. 8 and 9 show still another alternate form of the present invention. According to this alternate form, the liquid container 1 comprises a recessed chamber 2 at the front side thereof, which holds a picture film 4 and a convex lens 5, and a convex lens 3' forming a part of the back side wall thereof. The recessed chamber 2 has an embossed wall 21 showing a particular design facing the convex lens 3'.

Figure 10:
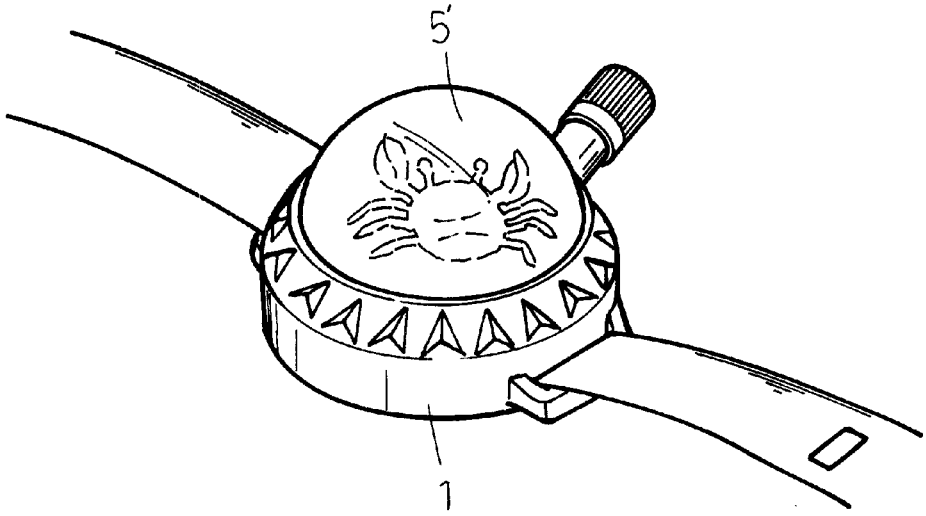
FIG. 10 is an elevational view of a seventh embodiment of the present invention.
Figure 11:
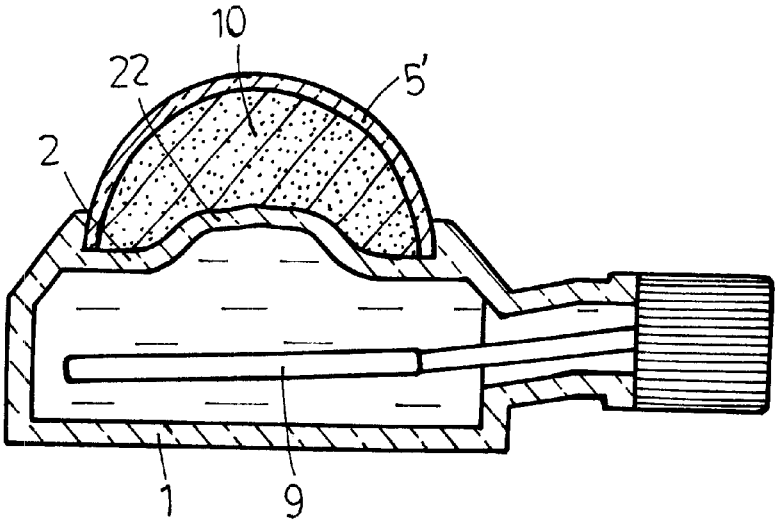
FIG. 11 is a cross sectional view of the seventh embodiment of the present invention.

FIGS. 10 and 11 show still another alternate form of the present invention. According to this alternate form, the liquid container 1 comprises a recessed chamber 2 at the front side thereof, a transparent, a semi-transparent water clay 10 filled in the recessed chamber 2, and a transparent, semi-spherical cover shell 5' covered on the recessed chamber 2 over the semi-transparent water clay 10. The recessed chamber 2 has an embossed wall 22 showing a particular design facing the semi-spherical cover shell 5'.

It is to be understood that the drawings are designed for purposes of illustration only, and are not intended for use as a definition of the limits and scope of the invention disclosed.

What the invention claimed is:

1. A bubble blower combination toy comprising:

a bubble blower having a liquid container holding a liquid and a bubble-blowing shaft inserted into said liquid container, said liquid container comprising a first recessed transparent chamber and a second recessed transparent chamber symmetrically disposed at two opposite sides;

a picture film mounted within said first recessed transparent chamber in said liquid container;

a convex lens covered on said first recessed transparent chamber and spaced from said picture film at a distance; and a lamp assembly installed in said second recessed chamber in said liquid container and operated to emit light through said picture film and said convex lens in said second recessed transparent chamber, said lamp assembly comprising a lamp holder holding a bulb, a battery cell, and a shell operated to control electric connection between said bulb and said battery cell.

2. A bubble blower combination toy comprising:

a bubble blower having a liquid container holding a liquid and a bubble-blowing shaft inserted into said liquid container, said liquid container comprising a recessed chamber at a front side thereof, said recessed chamber having an embossed wall showing a design facing a back side wall thereof;

a picture film mounted within said recessed chamber in said liquid container;

a first convex lens covered on said first recessed chamber and spaced from said picture film at a distance; and a second convex lens forming a part of the back side wall of said liquid container and facing the design of the embossed wall of said recessed chamber.

3. A bubble blower combination toy comprising:

a bubble blower having a liquid container holding a liquid and a bubble-blowing shaft inserted into said liquid container, said liquid container comprising a recessed chamber at a front side thereof, said recessed chamber having an embossed wall showing a design;

a semi-transparent water clay filled in said recessed transparent chamber in said liquid container; and a transparent, semi-spherical cover shell covered on said recessed chamber over said semi-transparent water clay through which the design of said embossed wall of said recessed chamber is viewed.

* * * * *